US006170097B1

(12) United States Patent
Lin

(10) Patent No.: US 6,170,097 B1
(45) Date of Patent: Jan. 9, 2001

(54) FOLDABLE SAUNA CABINET

(76) Inventor: Ding-Chen Lin, 17 Fl., No. 26-4, Ta Hsing W. Rd., Sec 2, Taur-Yuan City (TW)

( * ) Notice: Under 35 U.S.C. 154(b), the term of this patent shall be extended for 0 days.

(21) Appl. No.: 09/544,178

(22) Filed: Apr. 6, 2000

(51) Int. Cl.[7] ..... A61H 33/06

(52) U.S. Cl. ..... 4/524; 4/527; 4/526; 607/81; 607/83

(58) Field of Search ..... 4/524, 525, 526, 4/527, 528; 607/81, 83, 84

(56) References Cited

U.S. PATENT DOCUMENTS

| | | | | |
|---|---|---|---|---|
| 655,956 | * | 8/1900 | Cahoon | 4/527 |
| 2,539,710 | * | 1/1951 | Sziklay | 4/527 |
| 3,092,843 | * | 6/1963 | Wright | 4/527 |
| 3,649,971 | * | 3/1972 | Basa | 4/164 |
| 5,950,254 | * | 9/1999 | Yasue | 4/524 |
| 6,055,684 | * | 5/2000 | Azuma | 4/526 |

* cited by examiner

*Primary Examiner*—Henry J. Recla
*Assistant Examiner*—Huyen Le
(74) *Attorney, Agent, or Firm*—Michael D. Bednarek; Shaw Pittman

(57) ABSTRACT

A sauna cabinet includes an outer cover and an inner supporting frame and is provided at one side with an opening via which a heat source is guided into the sauna cabinet. The outer cover is provided at a front side with a closable slit via which a user enters or leaves the sauna cabinet, and at a rear side with a door leaf that may be turned open for mounting or removing the supporting frame into or from the outer cover. Two sides of the outer cover are made of two spaced layers to provide two narrow spaces. The supporting frame includes two foldable back plates and two side plates separately inserted into the two narrow spaces of the outer cover. When the sauna cabinet is in use, the two back plates are aligned with each other by two fixtures connected to upper and lower joints of the back plates. By removing the fixtures from the joints of the back plates, the latter may be easily folded and the two side plates may also be folded to overlap the back plates to largely reduce the space occupied by the sauna cabinet.

3 Claims, 8 Drawing Sheets

FOLDABLE SAUNA CABINET

BACKGROUND OF THE INVENTION

The present invention relates to a sauna cabinet, and more particularly to a foldable sauna cabinet that is collapsible to occupy largely reduced space when the sauna cabinet is not in use and is absolutely safe for use without the risk of burning a user.

The currently available household and commercial sauna cabinets can be divided into two major types, namely, oven type and steam type, based on the heat source generators equipped with the sauna cabinets. The oven-type sauna cabinet is equipped with a hot-air generator that supplies hot air while the steam-type sauna cabinet is equipped with a steam generator that supplies hot water vapor.

A conventional oven-type sauna cabinet is in the form of a steam cabinet in which a user may sit or lounge. A hot-air generator is mounted to a bottom of the steam cabinet to supply hot air into the whole cabinet. Hot air in the sauna cabinet sweats the user and is therefore beneficial to the user's metabolism and fitness. A disadvantage of such conventional oven-type sauna cabinet is that the hot-air generator, which is an electronic apparatus and mounted at the bottom of the cabinet, tends to become failed under the high-temperature working environment. And, it is not easy to repair the failed hot-air generator when it is mounted in the sauna cabinet.

A conventional steam-type sauna cabinet, such as that shown in FIG. 1, is also a steam cabinet 1 suitable for a user to sit or lounge therein. A pipe 11 extends from one side of the sauna cabinet 1 to a steam generator 2. An end of the pipe 11 inside the sauna cabinet 1 forms a spray nozzle 12 as shown in FIG. 2. The spray nozzle 12 is in the shape of a sector with a number of radially arranged steam spray holes 13. The steam generator 2 supplies hot water vapors into the sauna cabinet 1 via the pipe 11 and the steam spray holes 13, so that the sauna cabinet 1 is fully filled with hot steam to sweats the user. The hot steam also keeps an interior of the sauna cabinet 1 at a high humidity to help the user's metabolism and fitness. A disadvantage of the steam-type sauna cabinet 1 is that hot water vapors produced by the steam generator 2 are directly sent into the sauna cabinet 1 via the spray holes 13 on the spray nozzle 12. That is, there is not any shield between the spray nozzle 12 and the user in the sauna cabinet 1. Since the spray nozzle 12 is located at one side of the sauna cabinet 1 generally pointing toward the user's waist, the hot water vapors that are collectively and directly blown against the user's waist are prevented from diffusing quickly in the sauna cabinet 1 and tend to dangerously burn the user.

FIG. 3 shows an internal supporting frame 14 of the conventional sauna cabinet 1 that is covered with an outer cover 15. The supporting frame 14 is usually made of metal pipes that are not only expensive and difficult to machine and assemble but also bulky and heavy to cause difficulties in transport and storage of the sauna cabinet when the same is not in use. Moreover, the metal supporting frame 14 is a good thermal conductor. When the sauna cabinet 1 is in use, the supporting frame 14 tends to absorb heat and produces high temperature at its surface and would therefore possibly burn the user. In the event of an electric leakage, the supporting frame 14 would even very possibly cause a dangerous electric shock.

It is therefore tried by the inventor to develop a foldable sauna cabinet that occupies only very small space after being folded and is provided with means to eliminate the danger of burning a user.

SUMMARY OF THE INVENTION

A primary object of the present invention is to provide a foldable sauna cabinet that occupies only a very small space after being folded and is therefore convenient for transport and storage when the sauna cabinet is not in use.

Another object of the present invention is to provide a foldable sauna cabinet that is provided at one side with a spray nozzle that allows a heat source supplied into the sauna cabinet to quickly diffuse through the cabinet without the risk of burning a user.

To achieve the above and other objects, the sauna cabinet of the present invention mainly includes an outer cover and an inner supporting frame, the outer cover is provided at one lateral side with an opening via which a heat source is guided into the sauna cabinet, at a front side with a closable slit via which a user enters or leaves the sauna cabinet, and at a rear side with a door leaf that may be turned open for mounting or removing the supporting frame into or from the outer cover.

The foldable sauna cabinet is characterized in that two lateral sides of the outer cover are made of two spaced layers to provide a narrow space at each lateral side; that the supporting frame includes two pivotally connected back plates that maybe folded toward each other, and two side plates separately pivotally connected to outer ends of the two back plates for folding toward the back plates when necessary, one of the two side plates is provided with an opening corresponding to the opening at one side of the outer cover; that the two side plates of the supporting frame may be separately inserted into the narrow spaces at two sides of the outer cover; and that the two back plates of the supporting frame are fixed in an aligned position by connecting two fixtures to upper and lower ends of a joint between the two back plates. By removing the fixtures from the joint of the two back plates, the latter may be easily folded to each other and the two side plates may also be folded to overlap the back plates.

The foldable sauna cabinet of the present invention further includes a spray nozzle that is mounted in the openings provided at one side of the outer cover and the supporting frame and includes a front spray head and a rear connector. The spray head has a closed front face and a rear opening, and a collar provided around a middle area of an outer surface of the spray head and located in the sauna cabinet. A portion of the spray head in front of the collar is located in the sauna cabinet and provided at a top with a plurality of small air/steam spray holes and at a bottom with large openings. A portion of the spray head behind the collar forms a connecting end that is located outside the sauna cabinet and has multiple turns of brier teeth provided around an outer surface thereof to provide good surface friction. The rear connector is a hollow member for frictionally connecting to outer surface of the connecting end of the spray head and has a pipe axially connected to an inner bottom center of the rear connector with two ends of the pipe projected from front and rear sides of the connector.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
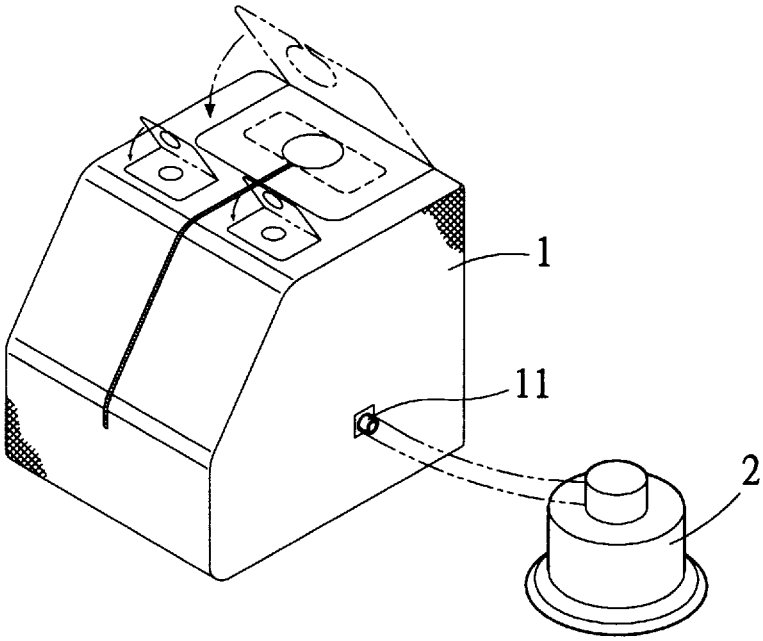
(PRIOR ART) Fig.1
FIG. 1 is a perspective view of a conventional steam-type sauna cabinet.
Figure 2:
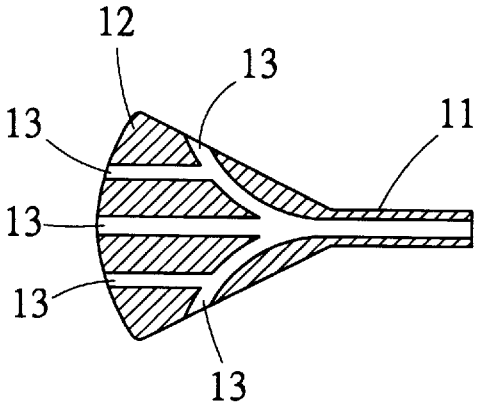
(PRIOR ART) Fig.2
FIG. 2 is a sectional view of a spray nozzle used with the conventional steam-type sauna cabinet of FIG. 1.
Figure 3:
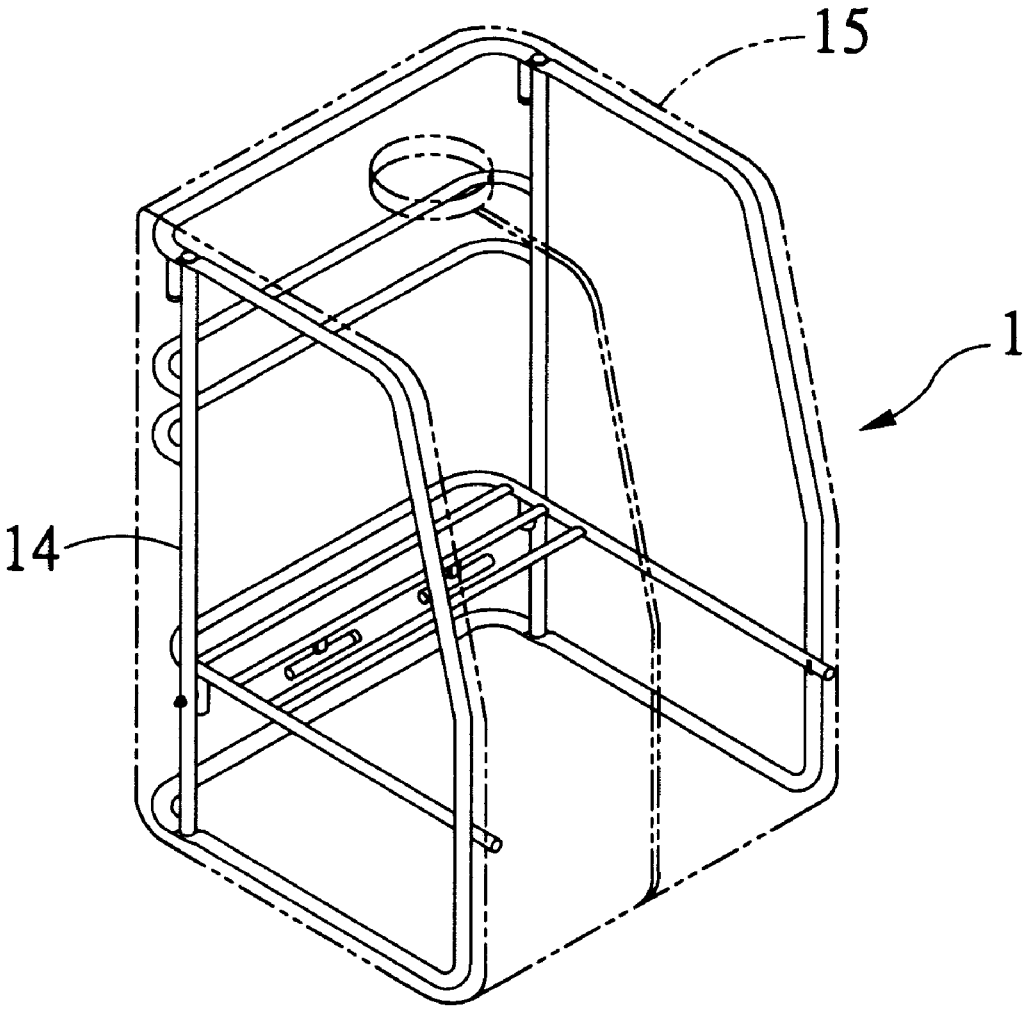
(PRIOR ART) Fig.3
FIG. 3 is a perspective view showing the internal structure of the conventional steam-type sauna cabinet of FIG. 1.
Figure 4:
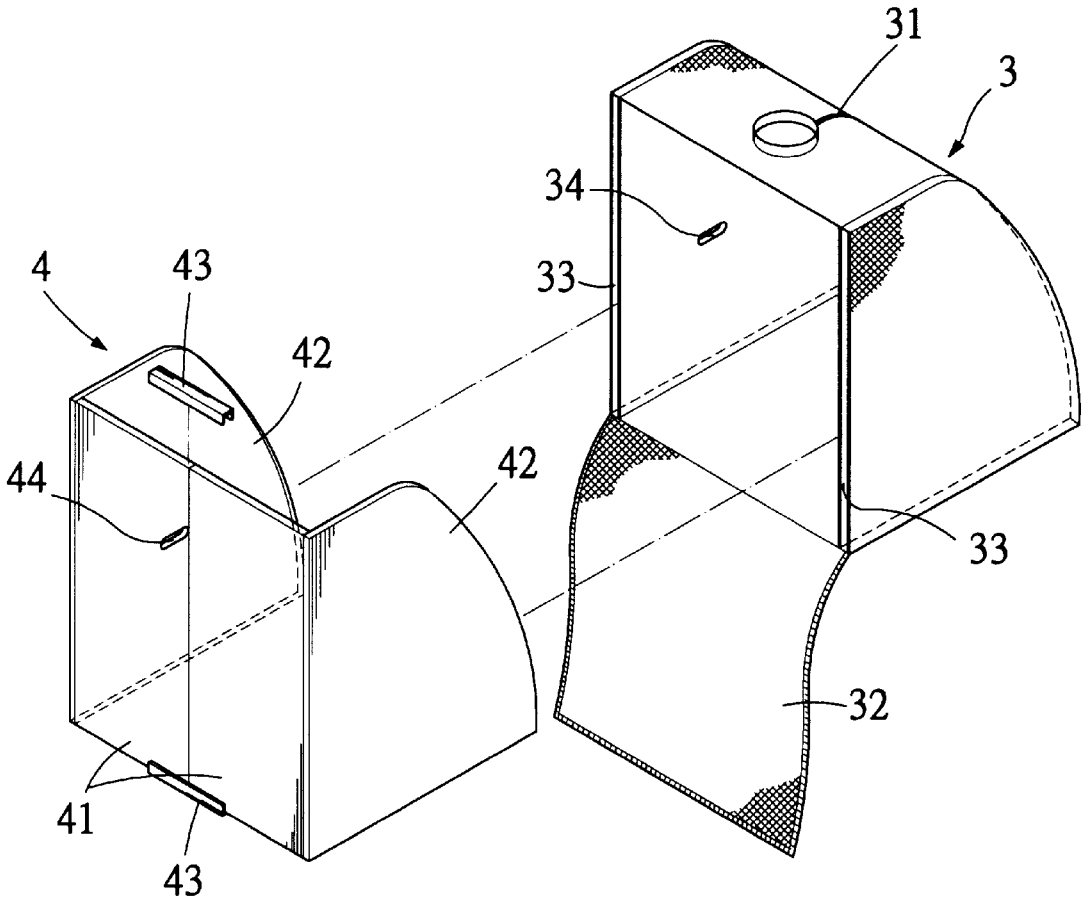
FIG. 4 is an exploded perspective of a foldable sauna cabinet according to the present invention.

Please refer to FIG. 4 that is an exploded perspective of a foldable sauna cabinet according to the present invention. As shown, the foldable sauna cabinet mainly includes a three-dimensional collapsible outer cover 3 and a foldable inner supporting frame 4.

The outer cover 3 is provided at a front side with a closable slit 31 via which a user may conveniently enter or leave the foldable sauna cabinet, and at a rear side with a door leaf 32 which may be turned open to facilitate mounting or removing the supporting frame 4 into or from the outer cover 3. Two lateral sides of the outer cover 3 are made of two spaced layers of material to provide a narrow space 33 at each side of the outer cover 3. One of the two lateral sides of the outer cover 3 is provided at a suitable position with an opening 34 that communicates an internal space of the outer cover 3 with a space outside the outer cover 3.

The supporting frame 4 includes two back plates 41 and two side plates 42. The two back plates 41 are connected to each other such that they may be turned to closely contact with one another. The two side plates 42 are separately pivotally connected to outer edges of the back plates 41, so that they may be turned toward the back plates 41 to closely contact with the latter. To ensure the two back plates 41 always abut against and align with each other at their inner edges, two elongated fixtures 43 having an n-shaped cross section may be separately connected to upper and lower joints of the two back plates 41. An opening 44 is provided at one of the side plates 42 corresponding to the opening 34 on one side of the outer cover 3.

To form a complete foldable sauna cabinet of the present invention, first open the door leaf 32 of the outer cover 3 and then align front edges of the two side plates 42 of the supporting frame 4 with the narrow spaces 33 provided at two lateral sides of the outer cover 3. Push the supporting frame 4 forward until the two side plates 42 are fully inserted into the two narrow spaces 33. Finally, turn the door leaf 32 to close the outer cover 3 and complete the sauna cabinet of the present invention.

To collapse the foldable sauna cabinet of the present invention, turn the door leaf 32 open to remove the supporting frame 4 from the outer cover 3. Remove the two fixtures 43 from the upper and the lower joints of the two back plates 41 for the latter to fold toward each other. And then turn the two side plates 42 toward the back plates 41 to overlap the latter. The folded supporting frame 4 occupies only a very small space.

At the openings 34 and 44 provided on one side of the outer cover 3 and the supporting frame 4, there is mounted a spray nozzle for guiding a heat source into the sauna cabinet.

Figure 5:
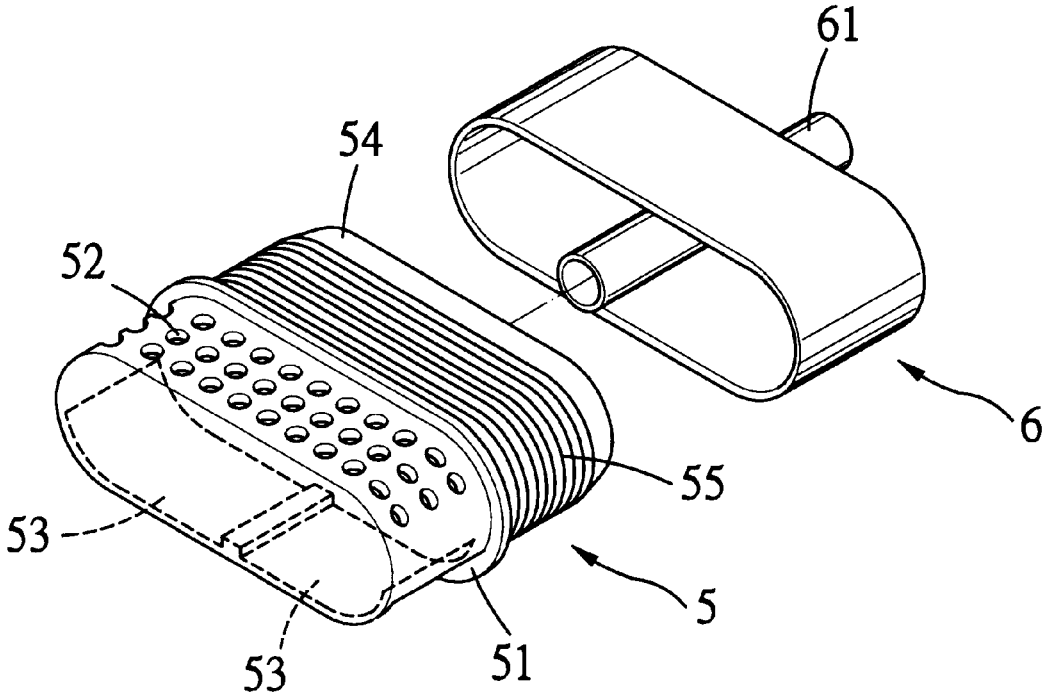
FIG. 5 is an exploded perspective of a spray nozzle used with the foldable sauna cabinet of the present invention.

Please refer to FIG. 5 that is an exploded perspective of the spray nozzle of the present invention. As shown, the spray nozzle includes a front spray head 5 and a rear connector 6.

The spray head 5 is an oblong hollow member having a closed front face and a rear opening. A collar 51 is provided around a middle area of an outer surface of the spray head 5. A portion of the spray head 5 in front of the collar 51 is provided with a plurality of small round holes 52 via which steam or hot air is sprayed into the sauna cabinet A bottom face of the front portion of the spray head 5 is provided with two large openings 53. A portion of the spray head 5 behind the collar 51 forms a connecting end 54 over which the rear connector 6 is connected. The connecting end 54 is provided around an outer surface with multiple turns of brier teeth 55 to enable good frictional contact of the connector 6 with the connecting end 54.

The rear connector 6 is a hollow member for frictionally connecting to outer surface of the connecting end 54 of the spray head 5. A pipe 61 is axially connected to an inner bottom center of the connector 6 with two ends projected from front and rear sides of the connector 6.

Figure 6:
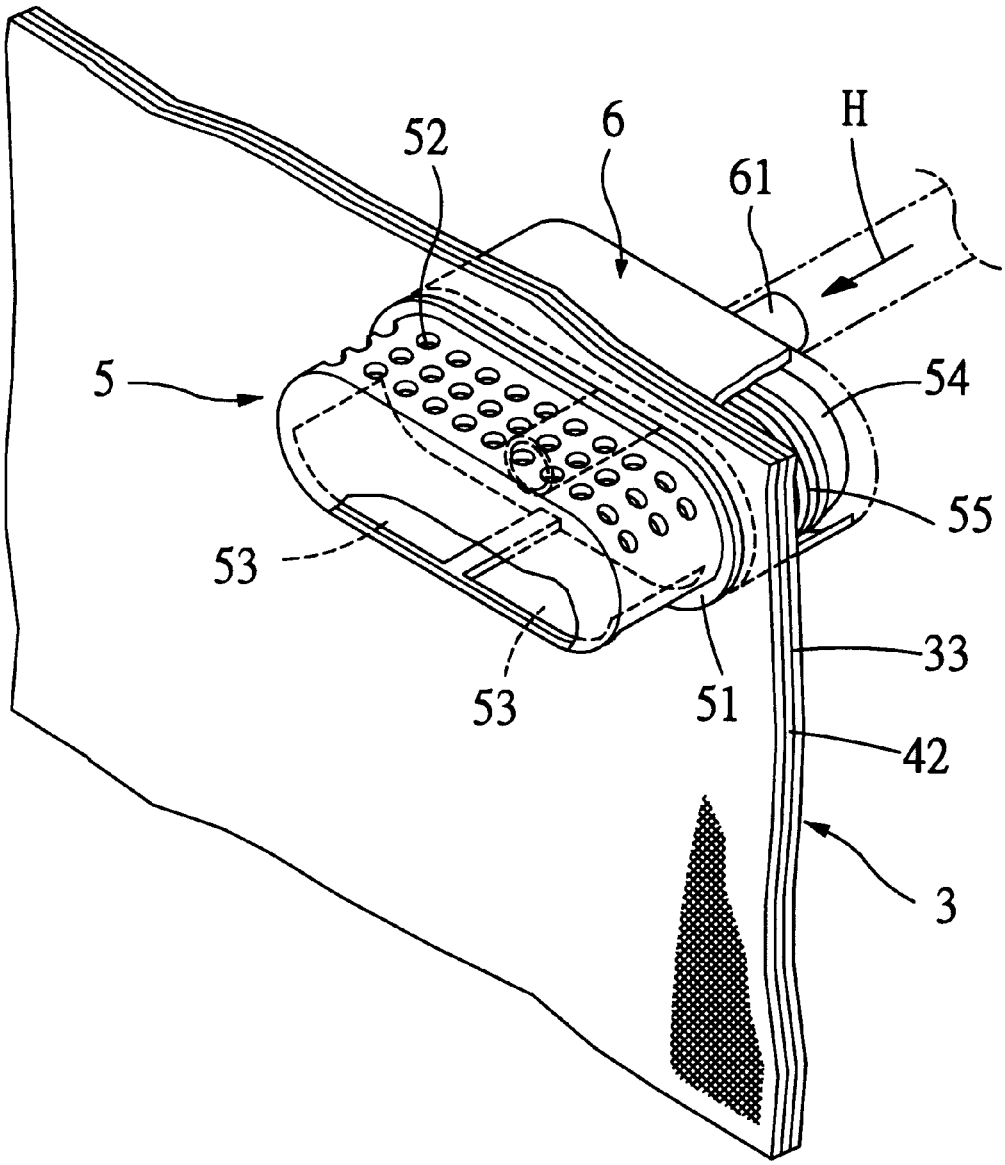
FIG. 6 illustrates the manner in which the spray nozzle of FIG. 5 is connected to the foldable sauna cabinet shown in FIG. 4 and the direction in which hot steam from a heat source flows into the foldable sauna cabinet.

Please now refer to FIG. 6. The spray head 5 of the spray nozzle of the present invention is mounted in the openings 34 and 44 correspondingly provided on the outer cover 3 and the supporting frame 4 to align with each other, such that the collar 51 is located at and tightly presses against an inner side of the outer cover 3 with the connecting end 54 projected from the opening 34 to locate at outer side of the outer cover 3. The connector 6 is then connected to outer surface of the connecting end 54 and fixed thereto. The pipe 61 is connected to a heat source generator (not shown) so that heat source H is guided by the pipe 61 into the spray head 5 before diffusing into the sauna cabinet via the small holes 52 and the large openings 53 provided at the top and the bottom of the front portion of the spray head 5.

The small holes 52 at the top of the spray head 5 are particularly designed for diffusing the heat source H. It is known that hot air and steam always flows upward. When a large amount of heat source H is guided into the spray head 5 that has a closed front face, the heat source H would first automatically diffuse upward via the small holes 52. Apart of the heat source H that does not diffuse via the small holes 52 is forced by a pressure in the spray head 5 to move downward and enter the sauna cabinet via the bottom openings 53. However, the part of heat source H diffused via the bottom openings 53 would again move upward to quickly diffuse through the sauna cabinet without directly rushing to and therefore burning a user in the sauna cabinet.

An end of the pipe 61 projected from a front side of the connector 6 directly extends into the spray head 5 when the connector 6 has been connected to the connecting end 54 of the spray head 5. This allows the heat source H to be directly guided into the sauna cabinet that has an internal temperature close to the temperature of the heat source H. If the pipe 61 stopped in the connector 6 instead of directly extending into the spray head 5, the heat source H would be exposed to a lower temperature outside the sauna cabinet and possibly condense into water drops before it enters the sauna cabinet.

Figure 7:
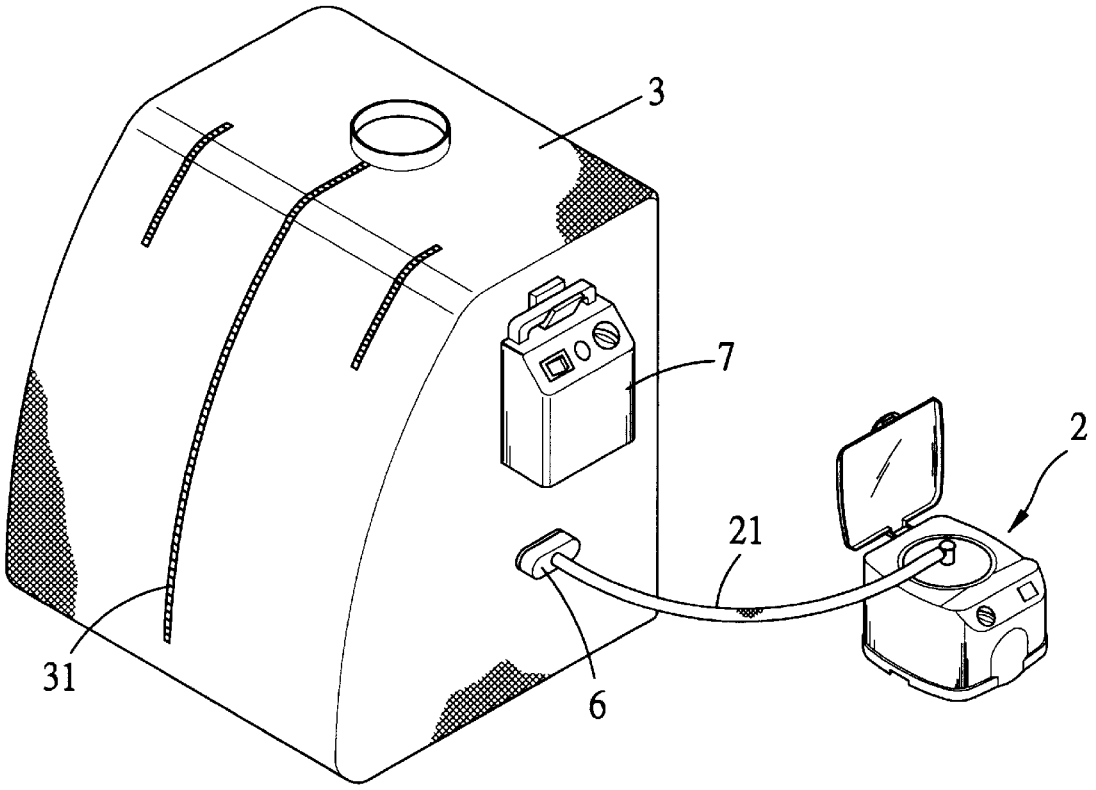
FIG. 7 is a perspective showing the foldable sauna cabinet of the present invention being used as a steam-type sauna cabinet.
Figure 8:
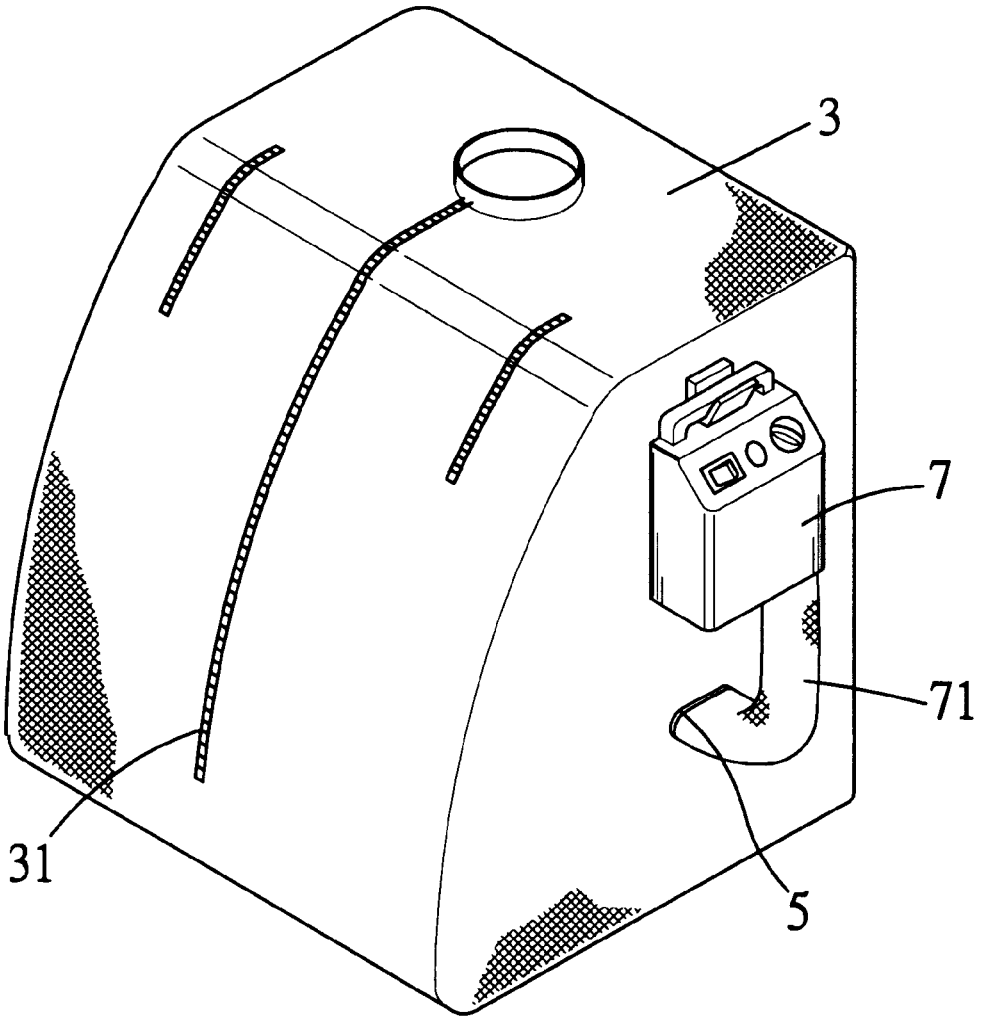
FIG. 8 is a perspective showing the foldable sauna cabinet of the present invention being used as an oven-type sauna cabinet.
Figure 9:
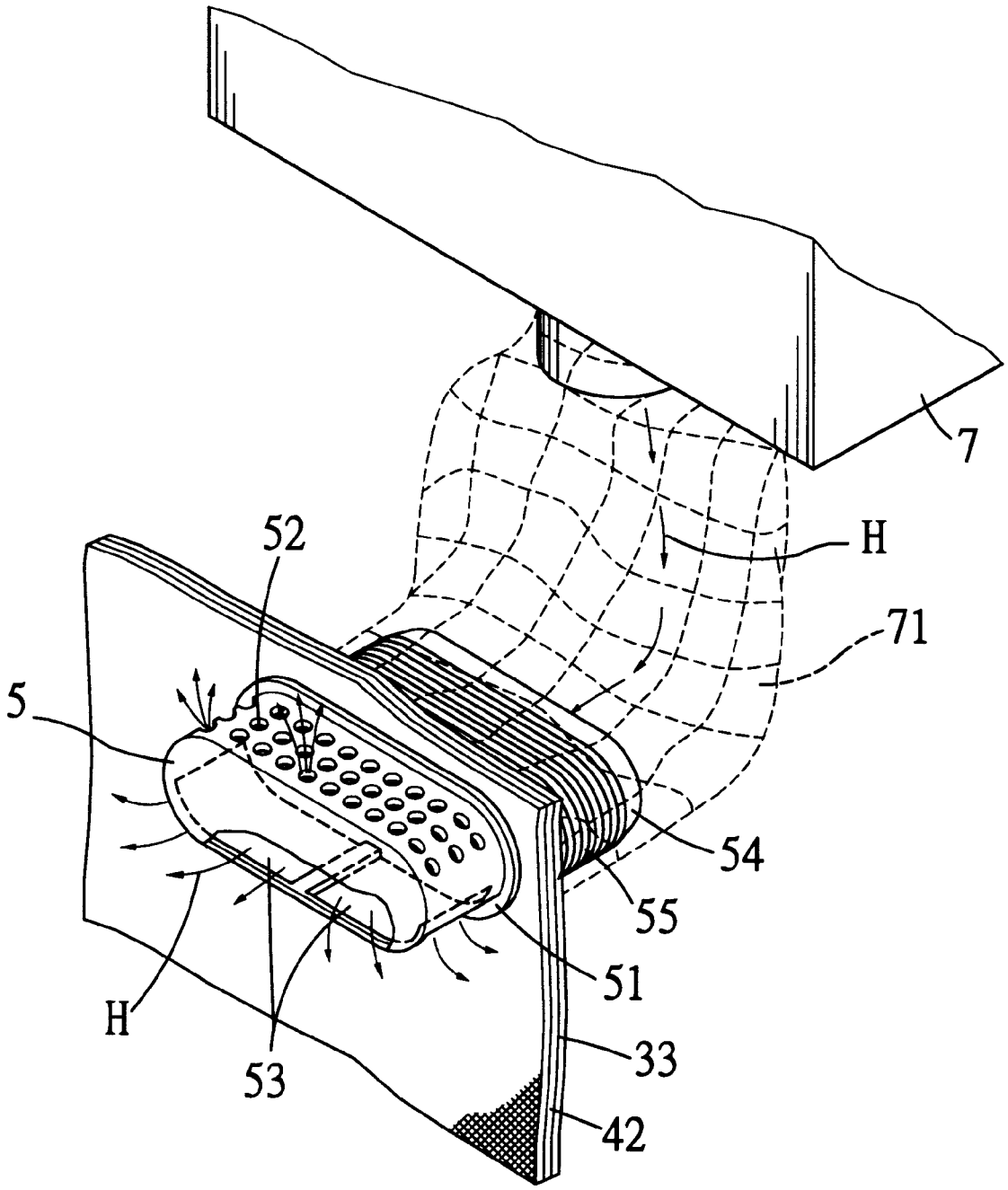
FIG. 9 is a fragmentary perspective showing the connection of a flexible pipe of FIG. 8 to the spray nozzle of the present invention for sending hot air into the foldable sauna cabinet of the present invention.

The heat source generator to be used with the sauna cabinet of the present invention may be a hot air generator or a steam generator. In FIG. 7, there is shown a foldable sauna cabinet of the present invention being used as a steam-type sauna cabinet. In this case, a steam generator 2 is provided outside the sauna cabinet with a hose 21 extended from the steam generator 2 to the pipe 61 of the connector 6. In FIG. 8, there is shown a foldable sauna cabinet of the present invention being used as an oven-type sauna cabinet. In this case, a hot-air generator 7 is attached to an outer wall of the sauna cabinet with a flexible pipe 71 extended from the hot-air generator 7 directly to the connecting end 54 of the spray head 5, as shown in FIG. 9, and the connector 6 is omitted.

The following are advantages of the foldable sauna cabinet of the present invention:

1. Both the supporting frame 4 and the outer cover 3 can be easily collapsed to largely reduce the space occupied by the sauna cabinet when it is not in use. The supporting frame 4 may be made of light-weight material to facilitate storage and transport of the whole sauna cabinet.

2. The supporting frame 4 is made of waterproof material and would not have any problem of heat-absorption. Any risk of burning the user can therefore be avoided.

3. The sauna cabinet may be used either as an oven-type or a steam-type sauna cabinet.

4. The heat source H guided into the sauna cabinet could diffuse quickly without the risk of burning the user.

5. When the sauna cabinet of the present invention is used as an oven-type sauna cabinet, the hot-air generator 7 is attached to outer wall of the cabinet and not subject to a high-temperature environment. Any damage to the hot-air generator possibly caused by high temperature can therefore be avoided. Such externally mounted position of the hot-air generator also facilitates maintenance and repair thereof.

It is to be understood that the embodiment of the present invention herein described is merely illustrative of the application of the principles of the invention. Reference herein to details of the illustrated embodiment is not intended to limit the scope of the claims, which themselves recite those features regarded as essential to the invention.

What is claimed is:

1. A foldable sauna cabinet comprising an outer cover and an inner supporting frame, said outer cover being provided at one lateral side with an opening via which a heat source is guided into said sauna cabinet, at a front side with a closable slit via which a user enters or leaves the sauna cabinet, and at a rear side with a door leaf that may be turned open for mounting or removing said supporting frame into or from said outer cover; and said foldable sauna cabinet being characterized in that two lateral sides of said outer cover are made of two spaced layers to provide a narrow space at each lateral side; that said supporting frame includes two pivotally connected back plates that may be folded toward each other, and two side plates separately pivotally connected to outer ends of said two back plates for folding toward said back plates when necessary, one of said two side plates being provided with an opening corresponding to said opening at one side of said outer cover; that said two side plates of said supporting frame are separately inserted into said narrow spaces at two sides of said outer cover; and that said two back plates of said supporting frame are fixed in an aligned position by connecting two fixtures to upper and lower ends of a joint between said two back plates.

2. A foldable sauna cabinet as claimed in claim 1, wherein said fixtures are long members having an n-shaped cross section.

3. A foldable sauna cabinet as claimed in claim 1, further comprising a spray nozzle mounted in said openings provided at one side of said outer cover and said supporting frame and including a front spray head and a rear connector; said spray head having a closed front face and a rear opening, and a collar provided around a middle area of an outer surface of said spray head and located in said sauna cabinet, a portion of said spray head in front of said collar being located in said sauna cabinet and provided at a top with a plurality of small air/steam spray holes and at a bottom with large openings, and a portion of said spray head behind said collar forming a connecting end that is located outside said sauna cabinet and has multiple turns of brier teeth provided around an outer surface thereof to provide good surface friction; and said rear connector being a hollow member for frictionally connecting to outer surface of said connecting end of said spray head and having a pipe axially connected to an inner bottom center of said rear connector with two ends of said pipe projected from front and rear sides of said connector.

* * * * *